US005953824A

United States Patent [19]

Ferraro et al.

[11] Patent Number: 5,953,824

[45] Date of Patent: Sep. 21, 1999

[54] RAZORS PROVIDING PIVOTING AND SWIVELLING RAZOR HEAD SUPPORT

[75] Inventors: Frank A. Ferraro, Trumbull; David C. Coffin, Milford; Andrew J. Pennella, Stamford; Brian Tubby, Milford, all of Conn.

[73] Assignee: Warner-Lambert Company, Morris Plains, N.J.

[21] Appl. No.: 08/935,753

[22] Filed: Sep. 23, 1997

[51] Int. Cl.[6] ..... B26B 21/00

[52] U.S. Cl. ..... 30/527; 30/528; 30/530; 30/531

[58] Field of Search ..... 30/527, 528, 529, 30/530, 531, 532, 533, 50

[56] References Cited

U.S. PATENT DOCUMENTS

| | | |
|---|---|---|
| 947,010 | 1/1910 | Woods . |
| 947,209 | 1/1910 | Woods . |
| 1,247,581 | 11/1917 | Seitz . |
| 1,639,441 | 8/1927 | Spahr . |
| 2,428,961 | 10/1947 | Courney . |
| 3,317,995 | 5/1967 | Bord . |
| 3,935,639 | 2/1976 | Terry et al. . |
| 3,950,848 | 4/1976 | Goldstein . |
| 3,964,160 | 6/1976 | Gordon . |
| 4,026,016 | 5/1977 | Nissen . |
| 4,152,828 | 5/1979 | Lund . |
| 4,198,746 | 4/1980 | Trotta . |
| 4,253,235 | 3/1981 | Jacobson . |
| 4,253,237 | 3/1981 | Jacobson . |
| 4,258,471 | 3/1981 | Jacobson . |
| 4,275,498 | 6/1981 | Ciaffone . |
| 4,281,455 | 8/1981 | Dixon et al. . |
| 4,281,456 | 8/1981 | Douglass et al. . |
| 4,282,650 | 8/1981 | Trotta . |
| 4,283,850 | 8/1981 | Douglass et al. . |
| 4,288,920 | 9/1981 | Douglass et al. . |
| 4,475,286 | 10/1984 | Saito . |
| 4,492,024 | 1/1985 | Jacobson . |
| 4,492,025 | 1/1985 | Jacobson . |
| 4,514,904 | 5/1985 | Bond . |

(List continued on next page.)

FOREIGN PATENT DOCUMENTS

| | | |
|---|---|---|
| 0271860 | 6/1988 | European Pat. Off. . |
| 0403839 | 12/1990 | European Pat. Off. . |
| 0203527 | 5/1986 | France . |
| 2619045 | 10/1989 | France . |
| 2639280 | 5/1990 | France . |
| 5622548 | 5/1981 | Japan . |
| 7505799 | 6/1995 | Japan . |
| 2025827 | 11/1982 | United Kingdom . |
| 2064410 | 12/1982 | United Kingdom . |
| 2078589 | 4/1983 | United Kingdom . |
| 2116470 | 9/1983 | United Kingdom . |
| 2172236 | 9/1986 | United Kingdom . |
| 8304386 | 12/1983 | WIPO . |
| 8910245 | 11/1989 | WIPO . |
| 9205018 | 4/1992 | WIPO . |
| 9320983 | 10/1993 | WIPO . |

*Primary Examiner*—M. Rachuba
*Attorney, Agent, or Firm*—Charles W. Almer

[57] ABSTRACT

Razors adapted to support a razor head during shaving while permitting the razor head to move relative to the razor in response to forces encountered during shaving. Preferred embodiments allow a razor head to swivel and also to pivot about an axis normal to a central axis of the razor and normal to an imaginary axis defined by the points of attachment of the razor to a razor head. According to another aspect, an engagement arm comprises a novel slot for controlling the movement of the engagement during shaving, as well as during loading/unloading of a razor head. Embodiments of this invention enable the razor head to maintain optimum shave relation with the skin regardless of the angular differences between the cartridge head, razor handle/grip and shaving motion during shaving.

32 Claims, 11 Drawing Sheets

U.S. PATENT DOCUMENTS

| | | |
|---|---|---|
| 4,516,321 | 5/1985 | Francis . |
| 4,573,266 | 3/1986 | Jacobson . |
| 4,587,729 | 5/1986 | Jacobson . |
| 4,739,553 | 4/1988 | Lazarchik . |
| 4,756,082 | 7/1988 | Apprille, Jr. . |
| 5,016,352 | 5/1991 | Metcalf . |
| 5,029,391 | 7/1991 | Althaus et al. . |
| 5,050,301 | 9/1991 | Apprille, Jr. . |
| 5,093,991 | 3/1992 | Hendrickson . |
| 5,152,064 | 10/1992 | Johnston . |
| 5,347,717 | 9/1994 | Ts'ai . |
| 5,426,853 | 6/1995 | McNinch . |
| 5,535,518 | 7/1996 | Althaus . |

RAZORS PROVIDING PIVOTING AND SWIVELLING RAZOR HEAD SUPPORT

The present invention is directed to improved razors which support a razor head and, more particularly, to razors which permit a razor head to swivel and pivot relative to a shaving stroke.

BACKGROUND

It is generally accepted that optimum shaving closeness and comfort are highly dependent on the optimum interface of the skin engaging elements and the skin surface being shaved. Shaving systems have been proposed which provide a razor head having a housing with relatively movable skin engaging elements, including a guard element, one or more blades, and a cap member. It has also been suggested to provide various degrees of movement to the entire razor head relative to the razor. The various embodiments of the present invention are directed to improvements in razors which permit a razor head to swivel and pivot in response to forces encountered during shaving which allows the razor cartridge to compensate for any lack of optimum relationship between the razor, cartridge and the skin being shaved.

Some of the previously disclosed arrangements for providing multiple degrees of movement include PCT Publication 93/20983 and U.K. Patent GB 2,116,470 which both disclose "swivel" movement which is commonly defined as pivoting about an axis which is parallel to an axis defined by the razor-cartridge engagement members.

Another system disclosed in GB 2,172,236 permits swivel motion and pivoting, but the pivoting movement causes blade movement to leave the notional plane of the surface being shaved. U.S. Pat. No. 5,535,518 discloses a four bar linkage system which allows pivoting and swivelling, but does not show springs or biasing elements for returning the razor head to a neutral position after the removal of shaving forces. The present invention is directed to improvements to shaving systems which allow a razor head to swivel and pivot relative to a razor during shaving.

SUMMARY OF THE INVENTION

Various embodiments of the present invention are directed to razors adapted to support a razor head during shaving while permitting the razor head to move relative to the razor in response to forces encountered during shaving. The various embodiments described herein allow a razor head to swivel and also to pivot about an axis normal to a central axis of the razor and normal to an imaginary axis defined by the points of attachment of the razor to a razor head.

Embodiments of the present invention restrict the movement of the razor head engagement arms to paths substantially parallel to a central longitudinal axis of the operative part of the razor during shaving. The engagement arms are also preferably restricted to movement within a single plane. The various embodiments provide shaving systems with improved blade-to-skin contact independent of wrist movement, while simultaneously reducing the amount of lateral movement of the razor head relative to the shaving path. As used herein, the term "razor head" is meant to include cartridges adapted to be connected to a separate razor as well as the operative cutting portion of a disposable razor wherein the handle and cutting portion are formed as a single unit.

According to another aspect of the present invention, a razor is provided with at least one movable engagement arm having a non-linear guide slot. According to a preferred embodiment of the present invention, the guide slot is provided in 2 engagement arms and comprises 3 segments designed to move the engagement portions of the engagement arms closer together for loading/unloading, and to maintain a more constant distance between the engagement portions during shaving. This preferred embodiment of the present invention provides more accurate movement of the engagement arms than previous designs and is easier to manufacture.

These and other advantages of the present invention are described in further detail below.

DETAILED DESCRIPTION

Figure 1:
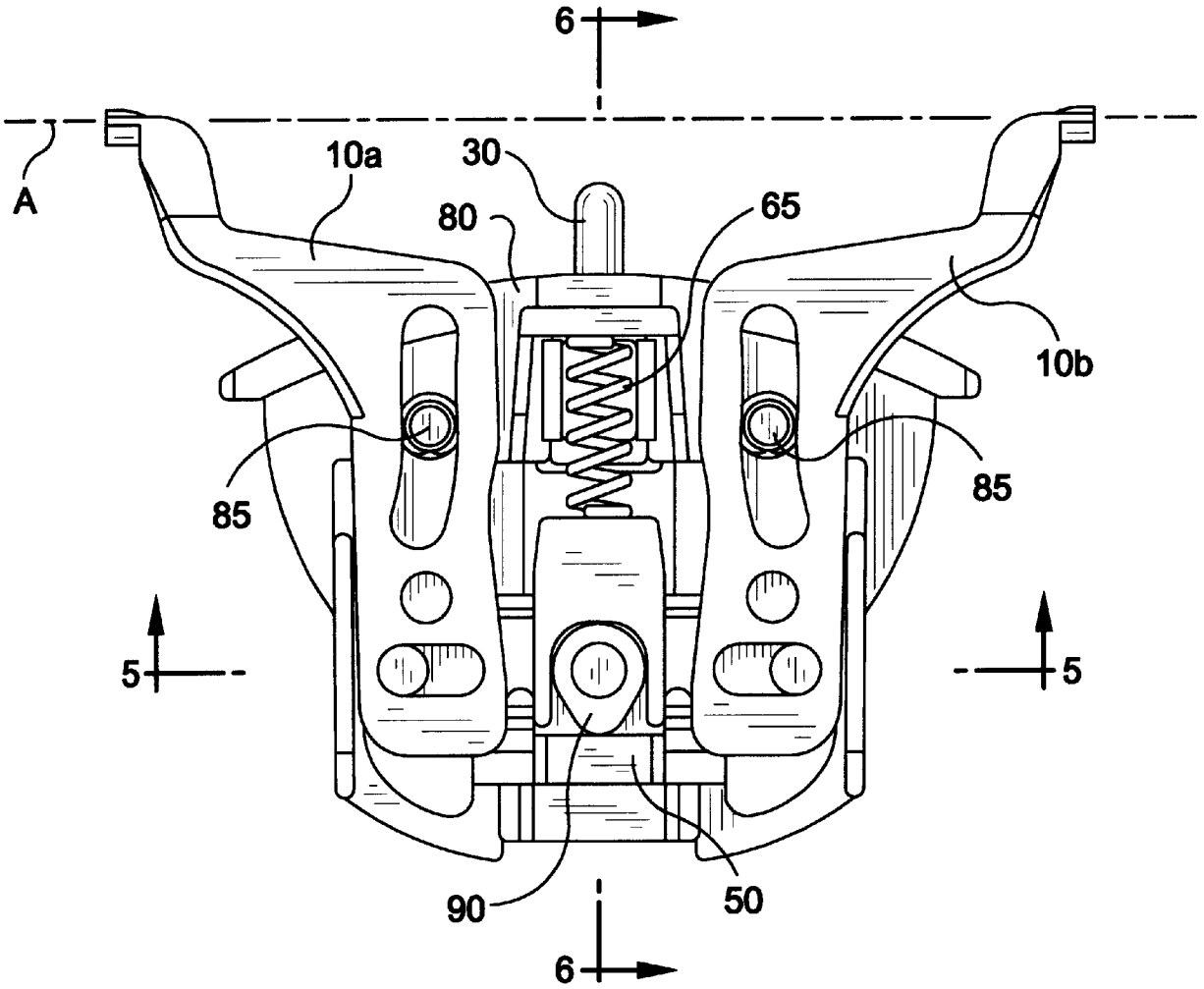
FIG. 1 is a top perspective view with sections removed from one embodiment of the present invention in a neutral position.
Figure 3:
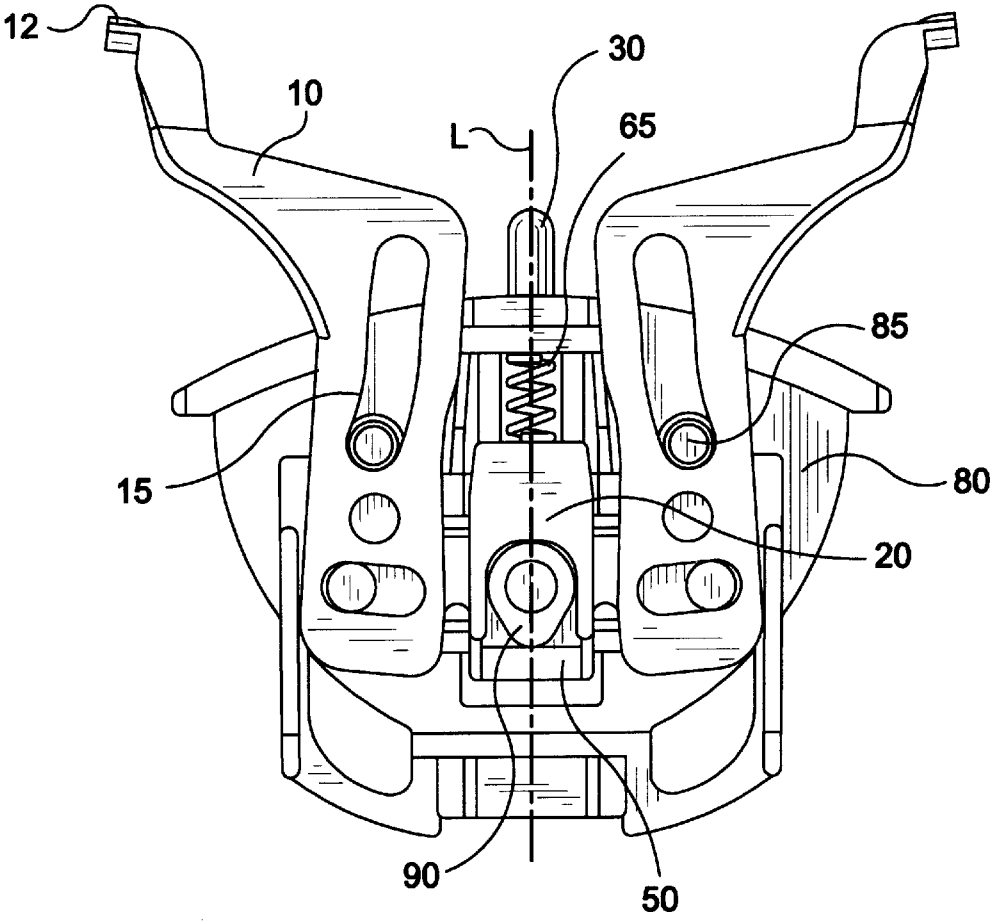
FIG. 3 is a top perspective view with sections removed from the razor of FIG. 1 in the load/unload position.
Figure 4:
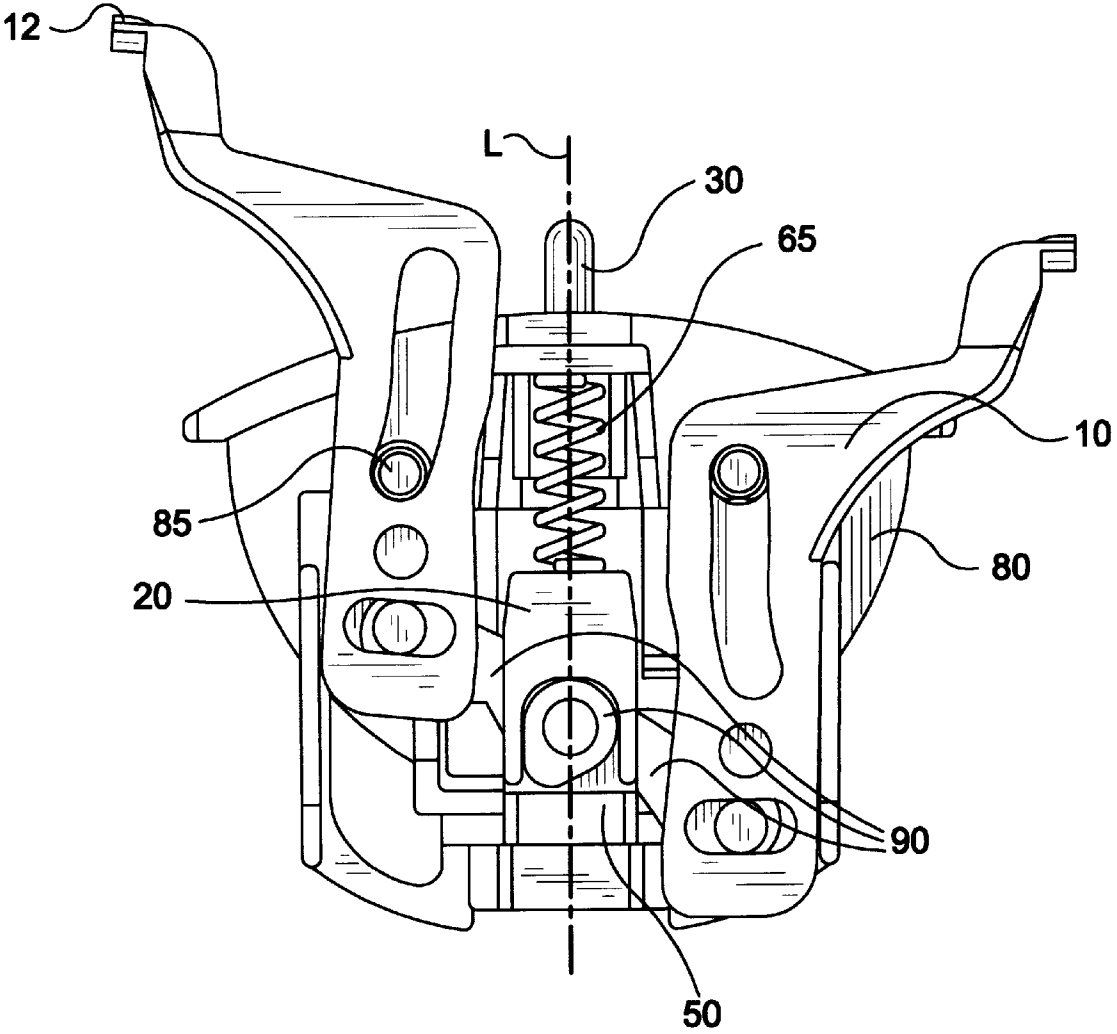
FIG. 4 is a top perspective view with sections removed from the razor of FIG. 1 in a swivel position.
Figure 6:
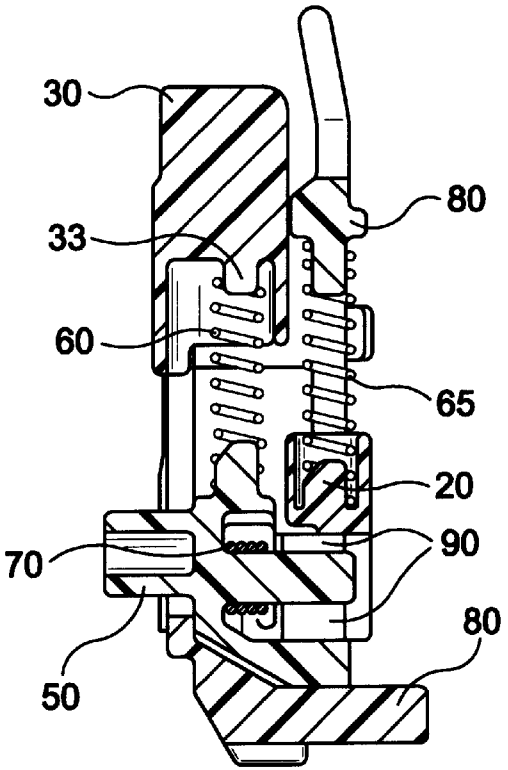
FIG. 6 is a cross sectional view taken along lines 6—6 of FIG. 1.
Figure 5:
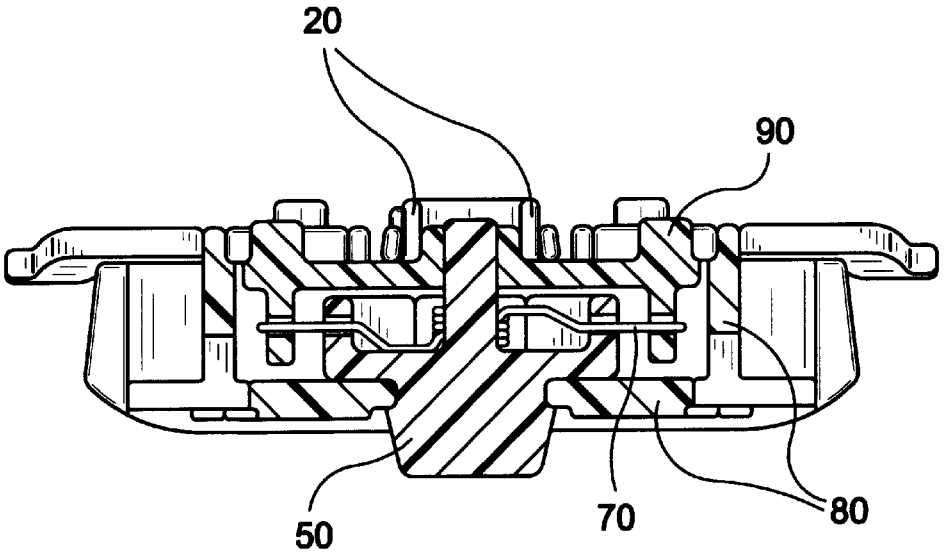
FIG. 5 is a cross sectional view taken along lines 5—5 of FIG. 1.
Figure 7:
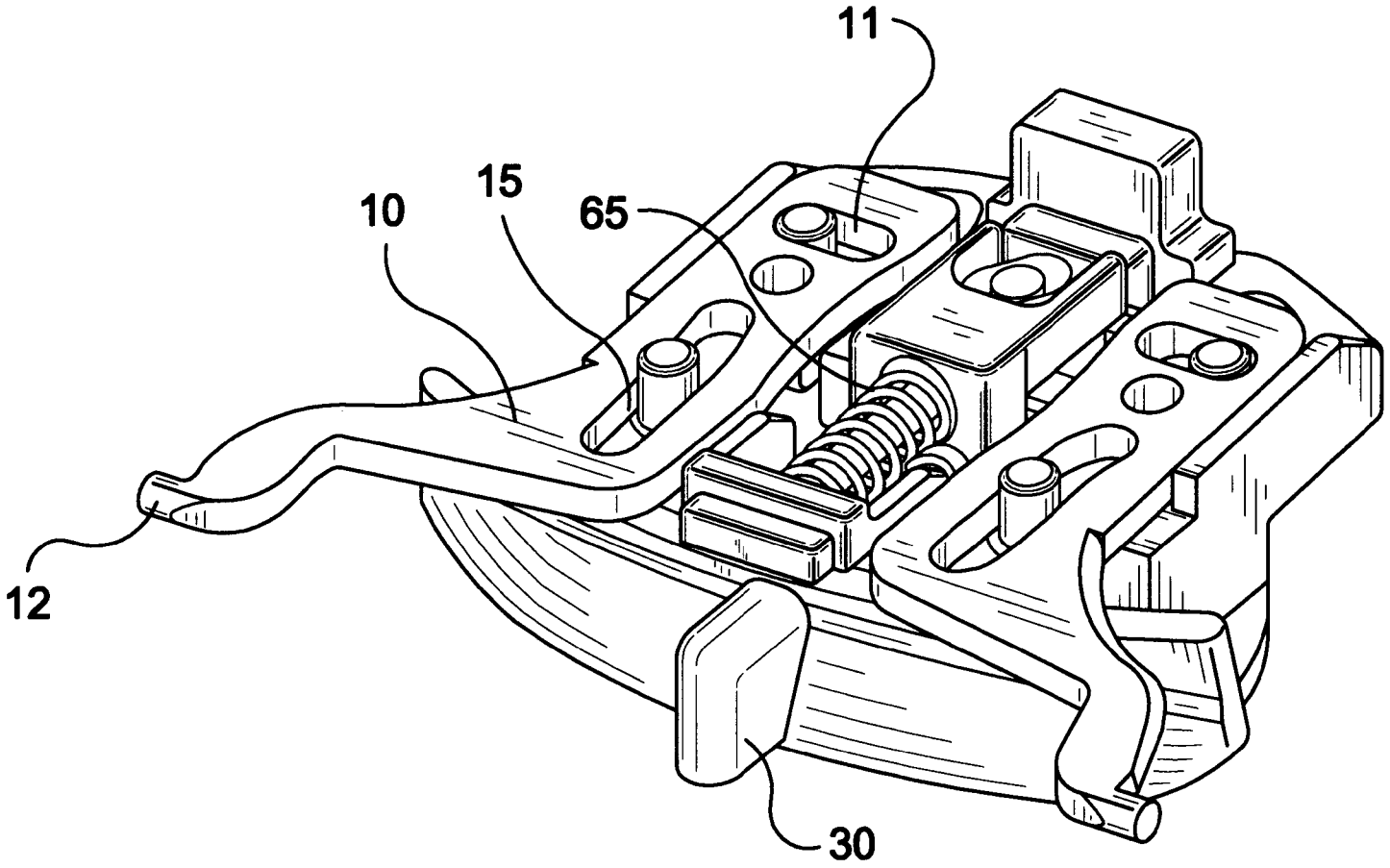
FIG. 7 is another perspective view of the razor shown in FIG. 1 in the neutral position.

FIGS. 1, 3 and 4 are top views of a razor of the present invention with sections removed. This illustrated embodiment is designed to engage a razor head (not shown) with a pair of engagement arms 10*a*, 10*b* which permit the razor head to swivel and pivot relative to the razor in response to forces encountered during shaving.

The illustrated razor head of the present invention comprises a pair of engagement arms 10, a plunger 30, an actuator 50, a plunger spring 60, a yoke spring 65, a torsion spring 70, a base 80, and a slidable cross beam 90. The engagement arms 10 are pivotally connected to the cross beam 90 and slidably guided by guide pins 85 of the base 80. In a manner described in further detail below, the forward and rearward movement of the engagements arms 10 is coordinated by the cross beam 90 which is both pivotally and slidably movable relative to the base 80. The plunger 30 is biased forwardly to return a razor head, which has swivelled, to a predetermined position. The engagement arms are also biased to return the razor head to a predetermined position, preferably normal to the central longitudinal axis of the razor after shaving forces have been removed.

Figure 2:
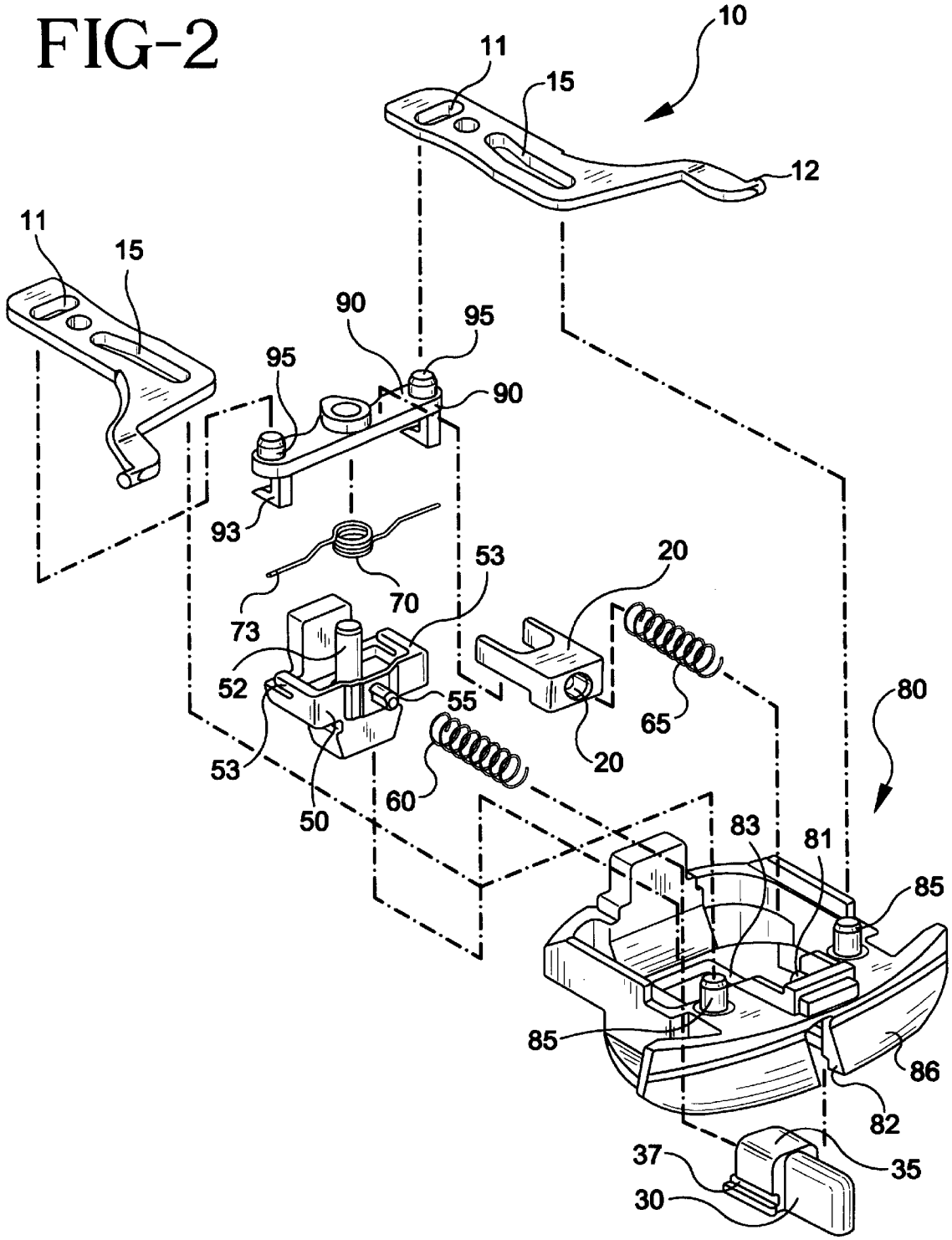
FIG. 2 is an exploded bottom view of the razor shown in FIG. 1.

The various movable elements of the illustrated razor are shown separately in the exploded, bottom view of FIG. 2. As illustrated, plunger 30 is forwardly biased by the upper end of plunger spring 60. The lower end of plunger spring 60 is positioned over a forward facing pin 55 of actuator 50. Therefore plunger spring 60 serves the dual purpose of forwardly biasing plunger 30 during shaving while providing a partial, rearwardly directed restoring force to actuator 50, as does spring 65, following loading/unloading of a razor head.

Actuator 50 also comprises a pivoting pin 52 which maintains torsion spring 70 and cross beam 90 in proper alignment. When actuator 50, torsion spring 70 and cross beam 90 are assembled, the resilient arms 73 of torsion spring 70 are received within rearwardly directed slots 53 of actuator 50 and slots 93 of cross beam 90. In this manner, the resilient arms 73 will only exert a restoring force on cross beam 90 when cross beam 90 has rotated on pivoting pin 52 to such a degree that the forward edge of a lateral slot 93 has moved more rearwardly than the forward edge of the corresponding actuator slot 53 and a resilient arm 73 of torsion spring 70 has engaged the cross beam 90.

As shown best in FIG. 2, the plunger 30 comprises a plunger base 35 having a pair of opposing slots 37 adapted to slidingly receive the sidewalls 83 of a cut out in base 80. Slots 37 in plunger base 35 thereby guide plunger 30 forwardly and rearwardly relative to base 80 along a central longitudinal axis L of the razor. (See FIG. 1) The forward portion of plunger 30 which engages a ramped surface of a razor head extends through an opening 82 of base cover 86. Rearward movement of the plunger relative to base 80 can be limited in any manner desired by those skilled in the art.

With reference again to FIG. 1, plunger 30 is forwardly biased and comprises a pin 33 which engages the forward end of plunger spring 60. The lower end of plunger spring 60 engages a pin 55 of actuator 50. This arrangement advantageously utilizes a single coil spring to provide forward biasing forces on plunger 30 and rearward biasing forces on an actuator 50 described in further detail below.

As stated above, in addition to swivel motion of the razor head, the razors of the present invention advantageously permit pivoting of the entire razor head on the razor. As used herein, the term "pivoting" is used to define movement of the razor head about or parallel to imaginary axis A—A.

The engagement arms 10 comprise engagement pins 12 adapted to be received within recesses of a razor head in a manner which permits the razor head to pivot about an axis substantially parallel to imaginary axis A—A defined by pins 12.

The illustrated engagement arms 10 also each comprise a pivot recess, preferably in the form of laterally extending lower slot 11 which receives a pivot member, preferably in the form of pin 95 of cross beam 90, and a non-linear upper slot 15 which receives a base pin 85.

Figure 8:
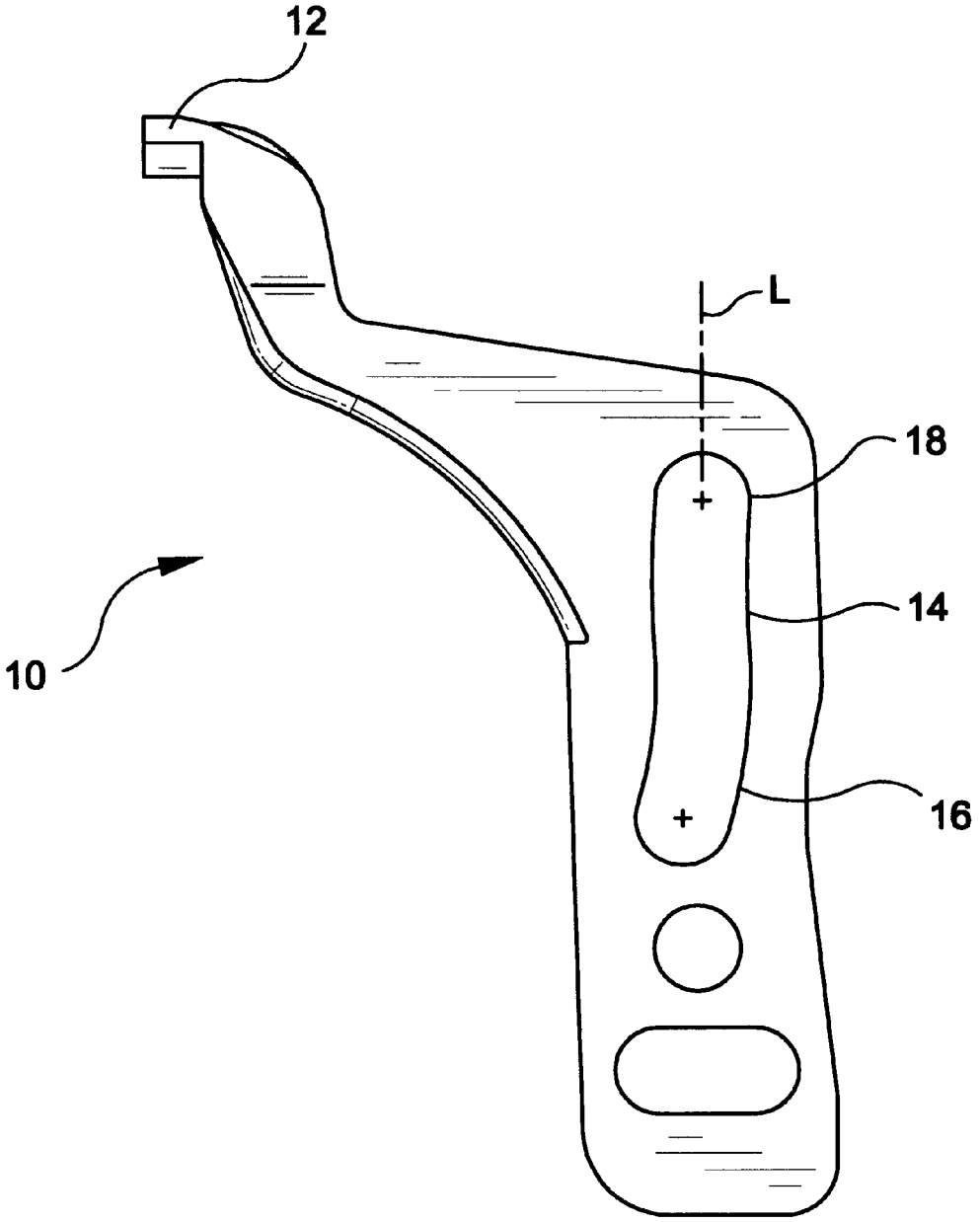
FIG. 8 is a top view of the left engagement arm of the illustrated razor.
Figure 9:
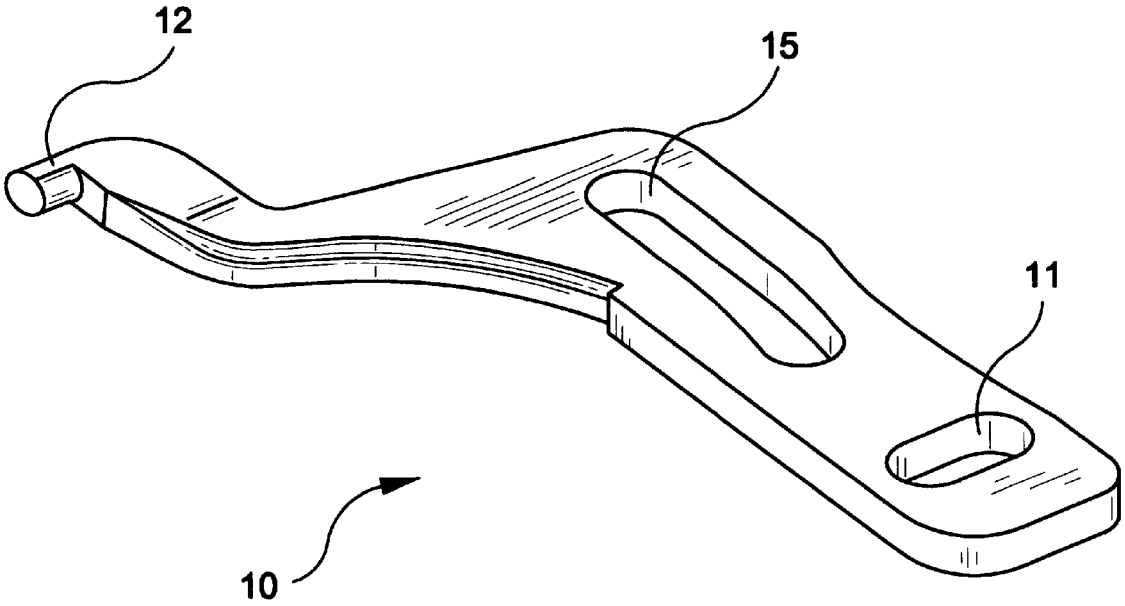
FIG. 9 is a top perspective view of the left engagement arm.
Figure 10:
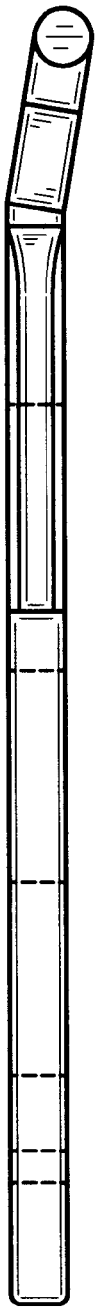
FIG. 10 is a left, side view of the right engagement arm shown in FIG. 1.

The engagement arms are maintained in a path which is substantially parallel to the central longitudinal axis L of the razor during shaving through the cooperative engagement of base pins 85 and guide slots 15. The base pins of this embodiment are advantageously integrally formed with the base 80 while, as stated above, the engagement arms 10 are movable in response to forces encountered during shaving and for loading/unloading. According to this preferred embodiment of the present invention, each of the upper guide slots 15 comprises three sections best shown in FIGS. 8 and 9 which control the position of engagement pins 12. A middle section 14 is substantially parallel to longitudinal axis L, while the lower section 16 angles inwardly from the middle section toward the center of the razor, while the upper section 18 is angled slightly away from the center of the razor. FIGS. 8–10 illustrate the left engagement arm in greater detail. This three-section configuration to the upper slots of engagement arms is designed to facilitate easy loading/unloading while maintaining a relatively constant distance between engagement pins 12 during shaving.

Those skilled in the art will appreciate that during the loading and unloading of a razor head on to the razor, it is desirable to bring the pins 12 of engagement arms 10 closer together. FIG. 3 illustrates the position of the engagement arms 10 when the actuator 50 and, consequently, the cross beam 90 are moved upwardly for loading. As illustrated, the forward movement of the engagement arms 10 brings the lower end of the engagement arm guide slots 15 to the base guide pins 85 thereby causing the engagement arms to pivot inwardly and engagement pins 12 to move inwardly to facilitate loading of a razor head.

After loading or unloading, the engagement arms 10 are returned to the retracted, spread-apart position by the cooperation of two biasing members in this illustrated embodiment. Plunger spring 60 positioned between plunger 30 and actuator 50 urges the actuator 50 rearwardly. Additionally, yoke spring 65 positioned between in spring recess 22 of yoke 20 and frame pin 81 also urge the cross beam, and consequently the actuator rearwardly. The combined restoring force of these springs returns the engagement arms 10 to the neutral position illustrated in FIG. 1.

The swivel movement of the engagement arms 10 and the cross beam 90 in response to forces exerted during shaving is illustrated in FIG. 4. In the example shown, the right engagement arm has been forced rearwardly bringing the base guide pin 85 into engagement with the upper section 18 of the guide slot right engagement arm 10. This causes the engagement pin 12 of the right engagement arm to move slightly outwardly away from the central axis of the razor. Simultaneously, the left engagement arm is moved upwardly by cross beam 90 thereby moving the lower portion 16 of the guide slot of left engagement arm into engagement with the left base guide pin 85 thereby causing the engagement pin 12 of the left engagement arm to move inwardly as discussed above in relation to FIG. 3.

The forward end of the engagement arms is angled slightly downwardly in order to provide clearance for the razor head which pivots and swivels during shaving.

The use of a multi-segmented guide slot having a plurality of angles provides several advantages not previously attained from other designs. For example, the use of slots having internal pins is believed to provide more accurate movement than utilizing outer cam surfaces on the outer sidewalls of engagement arms. The arrangement of the non-linear guide slot can be designed to a prescribed motion so as to maintain parallelism of movement during the actuation of the swivel action. Furthermore, the illustrated arrangement of a non-linear guide slot for the engagement arms can be manufactured relatively easily by simply stamping out the slot in one step. A plurality of external guide pins which would engage external cams surfaces of the engagement arms are also rendered unnecessary.

While the preferred illustrated embodiment comprises 2 engagement arms each comprising a 3 segmented slot, many of the advantages of the present invention could be obtained utilizing a razor comprising a base, a guide member and at least one engagement arm movably supported relative to the base comprising a non-linear slot which receives the guide member. Alternatively, though much less preferred, one or more linear slots could be utilized.

As shown in FIG. 4, it will be appreciated from the present description that the pivoting motion cooperates with the swivel motion of the razor head in order to provide optimum engagement between the skin engaging elements of the razor head and the skin surface being shaved.

Figure 11:
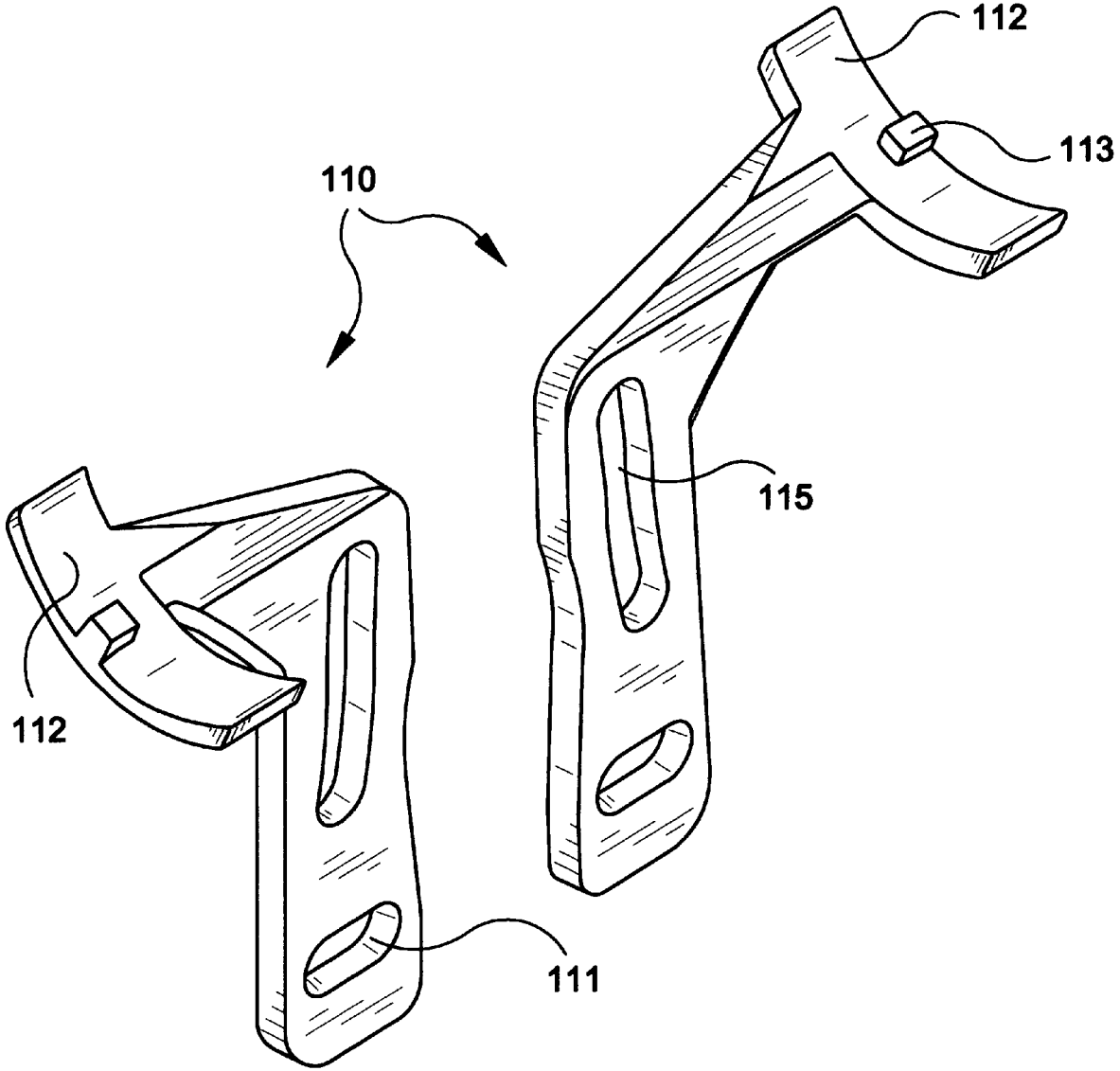
FIG. 11 is a perspective view of engagement arms of an alternative embodiment of the present invention.
Figure 12:
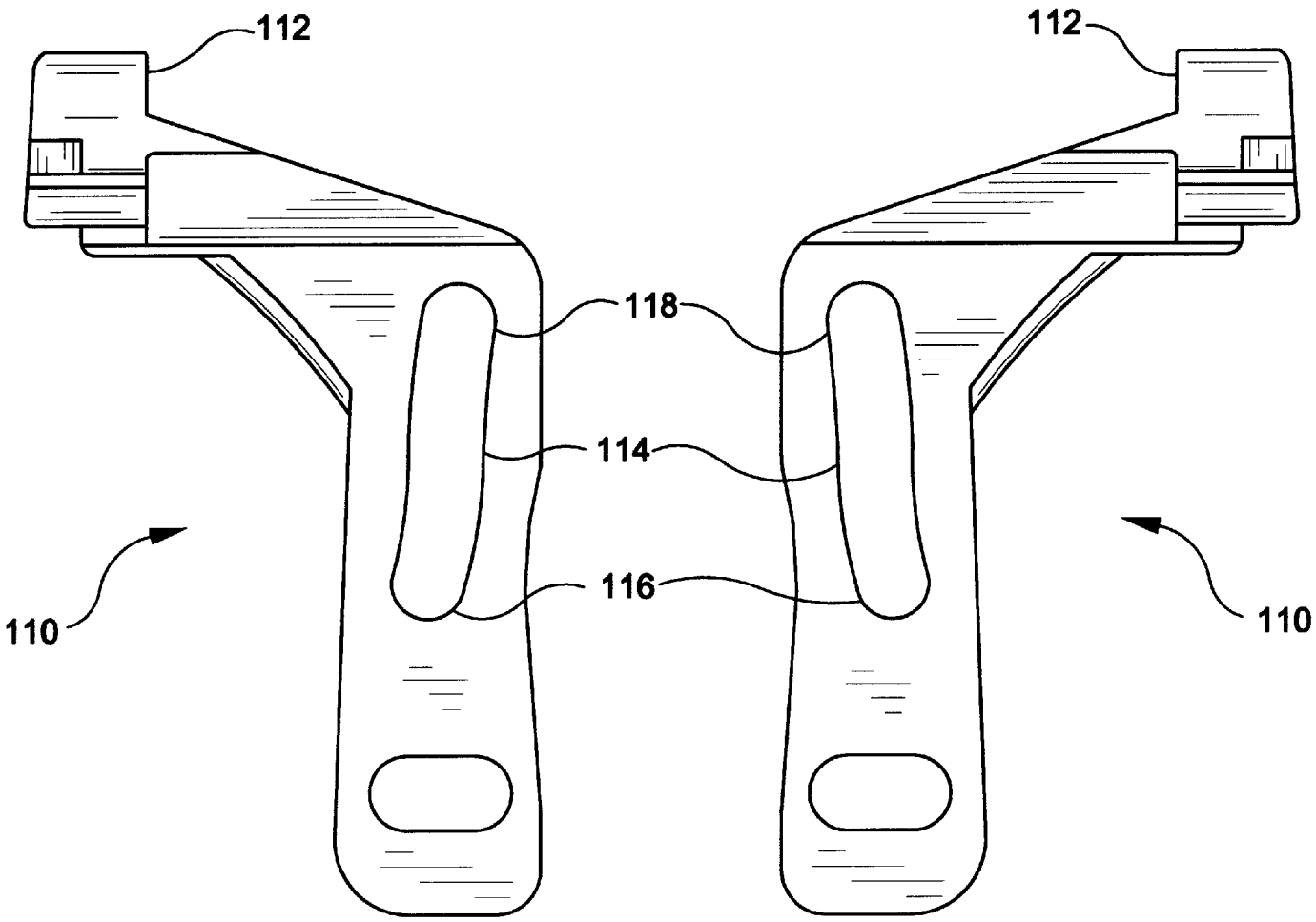
FIG. 12 is a top view of engagement arms of an alternative embodiment of the present invention.

According to another embodiment of the present invention illustrated in FIGS. 11 and 12 engagement arms 110 are advantageously provided with curved support faces 112 instead of the engagement pins 12 of the embodiment described above. These curved support faces are designed to cooperate with corresponding curved surfaces on the engagement portion of a razor head (not shown). Curved surfaces 112 also comprise detents 113 for limiting the movement of the razor head on these engagement arms. In other respects, engagement arms 110 are similar to engagement arms 10 described above. Specifically guide slots 115 comprise 3 sections, upper section 118, middle section 114 and lower section 116, and a lower guide slot 111 is provided in the lower end of these engagement arms. In this embodiment, the pivoting of the cartridge has a virtual axis substantially parallel to the two blade edges. This pivoting axis does not cause the blades to pivot away from the blade edge center point as it does in the embodiment described above.

We claim:

1. A razor for movably supporting a razor head comprising:

a base;

a guide member connected to said base; and at least one engagement arm slidably supported relative to said base, wherein said at least one engagement arm comprises an engagement portion for pivotally connecting a razor head to the razor and a non-linear slot which receives said guide member.

2. A razor according to claim 1, wherein said engagement arm further comprises a pivot recess which is adapted to receive a pivot member.

3. A razor according to claim 2 wherein said pivot recess is elongated.

4. A razor according to claim 2 further comprising a pivotable cross beam and wherein said pivot member is connected to said cross beam.

5. A razor according to claim 4 wherein said cross beam is supported for pivotal and sliding motion relative to said base.

6. A razor according to claim 1 comprising two engagement arms which are each slidably supported relative to said base.

7. A razor according to claim 6 wherein said engagement arms comprise engagement portions which remain in a single plane when moving in response to shaving forces exerted on a razor head.

8. A razor according to claim 1 wherein said non-linear slot comprises at least a first section having a first central axis and a second section having a second central axis, wherein said first central axis is disposed at an angle to said second central axis.

9. A razor according to claim 1 wherein said non-linear slot comprises at least one inner sidewall comprising three contiguous sections.

10. A razor according to claim 1 wherein said non-linear slot comprises a lower section and a upper section which is laterally offset from said lower section.

11. A razor according to claim 6 wherein said engagement arms move along substantially parallel paths in response to shaving forces exerted on a razor head.

12. A razor according to claim 2 further comprising a forwardly biased movable plunger for restoring a razor head from a swivelled position to a non-swivelled position.

13. A razor according to claim 12 further comprising means for biasing said plunger forwardly.

14. A razor according to claim 13 further comprising an actuator connected to said engagement arms for moving said engagement portions closer together.

15. A razor according to claim 14 wherein said biasing means and said restoring means bias said actuator rearwardly.

16. A razor according to claim 15 further comprising a cross beam pivotally and slidably connected to said base.

17. A razor according to claim 16 wherein said cross beam comprises two pivot members;

said razor comprises two engagement arms which each comprise a non-linear slot which receives a guide member, said engagement arms also each comprising a pivot recess;

wherein said pivot members are movably received in said pivot recesses.

18. A razor according to claim 17 wherein said pivot recesses are elongated.

19. A razor according to claim 17 wherein said cross beam is connected to a torsion spring which urges said cross beam to a neutral position after said cross beam has been pivoted relative to said base in response to shaving forces.

20. A razor according to claim 1 wherein said engagement arms are maintained in a first position in the absence of external forces and said razor further comprises means for restoring said engagement arms to said first position after external forces are removed.

21. A razor according to claim 20 wherein said restoring means comprises a torsion spring.

22. A razor for movably supporting a razor head for pivotal and swivel movement on said razor comprising:

a base;

a guide member connected to said base;

at least one engagement arm movably supported relative to said base, wherein said engagement arm comprises an engagement portion for pivotally connecting a razor head to the razor; and wherein said engagement arm comprises a non-linear slot which receives said guide member and is relatively movable with respect to said guide member.

23. A razor according to claim 22 wherein said engagement arm further comprises a pivot recess which is adapted to receive a pivot member.

24. A razor according to claim 23 further comprising a pivotable cross beam aid wherein said pivot member is connected to said cross beam.

25. A razor according to claim 24 wherein said cross beam is supported for pivotal and sliding motion relative to said base.

26. A razor according to claim 23 comprising two engagement arms which are each slidably supported relative to said base.

27. A razor according to claim 26 wherein said engagement arms comprise engagement portions which remain in a single plane when moving in response to shaving forces exerted on a razor head.

28. A razor according to claim 23 wherein said non-linear slot comprises at least a first section having a first central axis and a second section having a second central axis, wherein said first central axis is disposed at an angle to said second central axis.

29. A razor according to claim 23 wherein said non-linear slot comprises at least one inner sidewall comprising three contiguous sections.

30. A razor according to claim 23 wherein said non-linear slot comprises a lower section and a upper section which is laterally offset from said lower section.

31. A razor according to claim 26 wherein said engagement arms move along substantially parallel paths in response to shaving forces exerted on a razor head.

32. A razor according to claim 24 wherein said cross beam comprises two pivot members;

said razor comprises two engagement arms which each comprise a non-linear slot which receives a guide member, said engagement arms also each comprising a pivot recess;

wherein said pivot members are movably received in said pivot recesses.

* * * * *